United States Patent [19]

Mannhart et al.

[11] Patent Number: 4,559,691

[45] Date of Patent: Dec. 24, 1985

[54] DEVICE FOR SECURING A SLEEVE ON THE ABUTTING ENDS OF REINFORCING BARS

[75] Inventors: Alto Mannhart, Munich; Georg Rieger, Germering, both of Fed. Rep. of Germany

[73] Assignee: Dyckerhoff & Widmann Aktiengesellschaft, Munich, Fed. Rep. of Germany

[21] Appl. No.: 601,740

[22] Filed: Apr. 19, 1984

Related U.S. Application Data

[63] Continuation of Ser. No. 356,332, Mar. 9, 1982, abandoned.

[30] Foreign Application Priority Data

Mar. 13, 1981 [DE] Fed. Rep. of Germany ..... 3109687

[51] Int. Cl.[4] ..... B23P 11/00

[52] U.S. Cl. ..... 29/283.5; 29/237; 29/252; 29/520; 72/453.02

[58] Field of Search ..... 29/234, 252, 282, 283.5, 29/237, 520; 72/274, 284, 285, 287, 290, 293, 316, 453.02, 467, 481

[56] References Cited

U.S. PATENT DOCUMENTS

| | | | |
|---|---|---|---|
| 11,318 | 3/1893 | Moltrup | 72/481 |
| 686,365 | 11/1901 | Thackray | 72/481 |
| 2,660,780 | 12/1953 | Beck | 29/235 |
| 2,860,775 | 11/1958 | Brauchler | 72/467 |
| 3,019,520 | 2/1962 | Woolley | 29/282 |
| 3,559,270 | 2/1971 | Beghi | 29/520 |
| 3,726,122 | 4/1973 | Dawson | 72/453.02 |
| 3,744,293 | 7/1973 | Miller | 72/467 |
| 3,849,858 | 11/1974 | Whitledge et al. | 29/283.5 |
| 4,019,232 | 4/1977 | Hattori | 29/283.5 |
| 4,028,797 | 6/1977 | Miller | 29/235 |
| 4,057,882 | 11/1977 | Bowner | 29/237 |
| 4,285,228 | 8/1981 | Gunning | 29/237 |
| 4,345,361 | 8/1982 | Baumann | 29/237 |

FOREIGN PATENT DOCUMENTS

| | | | |
|---|---|---|---|
| 1115007 | 10/1961 | Fed. Rep. of Germany | 29/237 |
| 1320320 | 6/1973 | United Kingdom | 72/481 |

*Primary Examiner*—Daniel C. Crane

*Attorney, Agent, or Firm*—Toren, McGeady, Stanger, Goldberg & Kiel

[57] ABSTRACT

A device for securing a sleeve on the abutting ends of two axially aligned reinforcing bars includes an upper device part, a lower device part aligned below the upper device part and a drawing die mounted on the lower device part. Cylinder-piston units interconnect the upper and lower device parts for moving the drawing die over the sleeve and coupling the reinforcing bars together. The cylinder-piston units are disposed in parallel relation to one another and to the axis of the drawing die. At least one cylinder-piston unit provides the drawing force and another provides a counteracting force. The cylinder-piston units are both located on the same side of the drawing device axis and are spaced at different distances from the drawing die axis.

11 Claims, 15 Drawing Figures

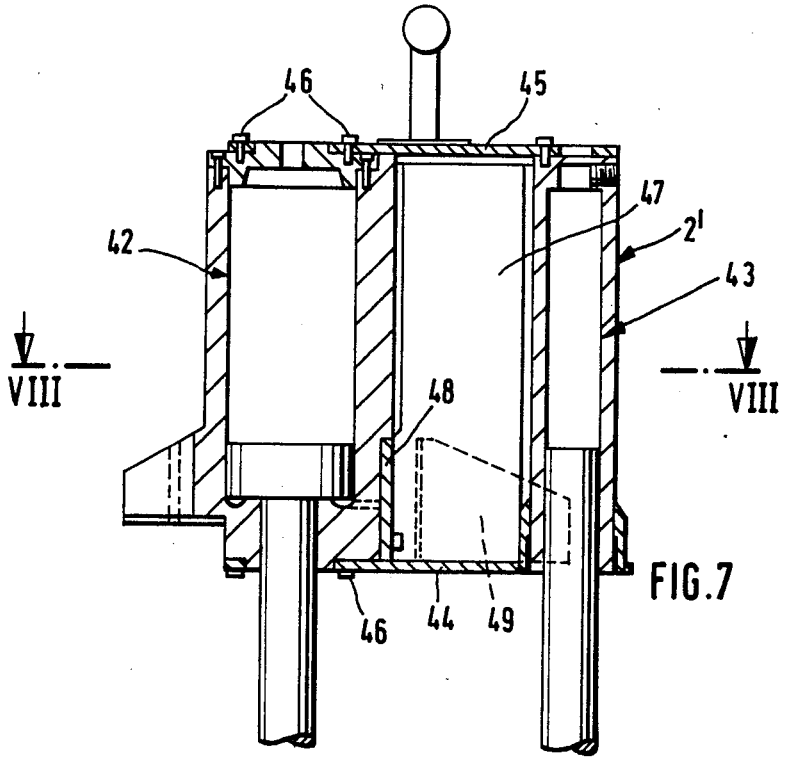
FIG.7
FIG.8
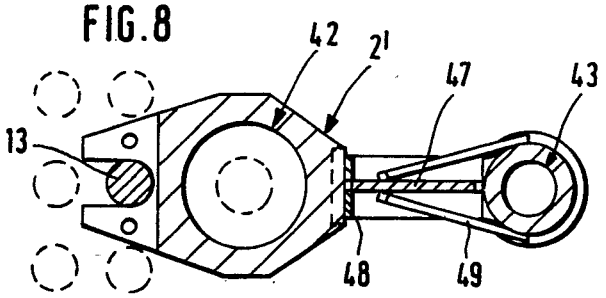

DEVICE FOR SECURING A SLEEVE ON THE ABUTTING ENDS OF REINFORCING BARS

This is a continuation of application Ser. No. 356,332, filed Mar. 9, 1982 abandoned.

SUMMARY OF THE INVENTION

The present invention is directed to a device for coupling two reinforcing bars which have their ends in abutting relation. Preferably the surface of the reinforcing bars is deformed or profiled. The reinforcing bars are coupled together by a sleeve pressed onto the abutting ends of the bars by a drawing die. The device includes an upper device part and a lower device part with the drawing die mounted on the lower device part. Cylinder-piston units displace the lower device part relative to the upper device part and move the drawing die over the sleeve. The cylinder-piston units are located in the upper device part and they are disposed parallel to the axes of the reinforcing bars and are supported relative to the coupling sleeve.

To couple the abutting ends of reinforcing bars, so-called pressure sleeve joints are known. In such joints, a sleeve is slid over the ends of the bars to be connected and the sleeve is deformed by applying external forces acting radially relative to the reinforcing bar axes so that the internal surface of the sleeve is displaced into contact with the outer surface of the reinforcing bars. The sleeve is deformed either by rolling between appropriate rolls or by the application of radial pressure using appropriate tools in a single work step over the entire length of the sleeve or in several work steps incrementally over the length of the sleeve.

Reinforcing bars, that is, ribbed reinforcing bars, have a deformed or profiled outer surface usually in the form of ribs to improve the bond with the concrete in which the bars are embedded. If it is assured that the material of the sleeve fits tightly about the deformed surfaces of the reinforcing bars, the deformed surfaces further improve the sheer bond between the reinforcing bars and the sleeve. Such engagement of the sleeve with the bars cannot always be attained in known arrangements, however, where the deforming pressure is applied to the sleeve only in a radial plane. For manufacturing reasons, the deformations on hot-rolled reinforcing bars are always located onto oppositely located sides. In particular, when one bar is already embedded in the concrete before the other bar is to be connected with it, it is not possible to align the direction of pressure application during the deformation of the sleeve so that the ribs of both bars, located in different planes, can be grasped. Accordingly, to achieve the desired connection of the sleeve to the bars, it has been known to deform the sleeve in each cross section in several different radial directions, however, such an operation involves twice the number of work steps.

Finally, it has also been known to deform a sleeve by pressing it through a drawing die whereby, similar to the drawing of wires, the diameter of the sleeve is reduced. In such an operation, radial deformation forces are applied to the sleeve from all sides and the sleeve, due to this manner of force application, makes contact with the entire surface of the reinforcing bars.

In reinforced concrete construction, however, it is not only necessary that the reinforcing bars be coupled together, it is particularly desirable that the coupling can be performed at the construction site. As an example, it is often necessary to connect or couple reinforcing bars with the ends of reinforcing bars which extend outwardly from a previously poured concrete section. Therefore, a device for producing such pressure sleeve joints must not only be portable, but it must be constructed so that the pressure sleeve joints can be made when several reinforcing bars are arranged next to one another with a minimum spacing between them as required by construction practices.

In a known device of the type described above, two symmetrical parts are placed against two sides of a reinforcing bar and can be connected in a tension-proof manner against radial pressure so that they surround the bar, note West German Offenlegungsschrifts Nos. 24 37 199 and 27 15 190. Each of the parts of such a device has two hydraulic cylinder-piston units and while the upper device part is supported relative to the sleeve, they pull a drawing die mounted on the lower device part over the sleeve causing the sleeve to yield or stretch. Aside from the fact that this arrangement is difficult and cumbersome to handle, it requires considerable space on all sides around the reinforcing bars to be coupled, because of its two part construction. Accordingly, its use with reinforcing bars placed at the minimum spacing is not possible.

Therefore, the primary object of the present invention is to provide a device of this general type which is easy to handle and produces effective pressure sleeve joints even when a number of reinforcing bars are to be interconnected and are spaced closely laterally apart.

In accordance with the present invention, in a device of the above-described type, one or more cylinder piston units are arranged as drawing cylinders located on one side of the drawing die and on the same side and spaced laterally from the drawing cylinder there is at least another cylinder-piston unit which acts as a counteracting cylinder. The pressurizing medium is supplied to the two different cylinders in opposite directions relative to the axial direction of the cylinders.

In one preferred embodiment, two cylinder-piston units, each providing a drawing cylinder, are located symmetrically on the opposite sides of a plane extending in the axial direction of the cylinders and including the axis of the drawing die. Advantageously, the piston surfaces within the drawing cylinder and the counteracting cylinder are in inverse ratio relative to their distances from the axis of the drawing die.

To support the device relative to the sleeve, the upper device part includes a fork-shaped bracket. A support sleeve is provided on and is connected to the bracket in a frictionally engaging and form-locking manner. The support sleeve can be made up of two shell-like parts combining to surround the reinforcing bar with each part having an outwardly extending flange-like projection at its upper end. The two parts of the support sleeve each with a flange-like projection can be connected to the bracket for rotation about axes parallel to the axis of the drawing die. In one embodiment, springs can be utilized for holding the two parts of the support sleeve in the closed position.

Preferably, the lower device part has a base plate connected to the drawing cylinder or cylinders and to the counteracting cylinder with the drawing die arranged at the end face of the base plate.

Advantageously, the base plate is in the form of a fork with a longitudinal slot with the drawing die positioned in a recess at the inner end of the slot. When the drawing die is inserted into the recess in the base plate it widens the longitudinal slot. Preferably, the drawing die is composed of at least two annular parts which combine to form a closed annular member. In a preferred arrangment, the drawing die consists of two arcuate parts, one shorter than the other with the shorter one fixably but releasably connected to the base plate such as by screws. The longer arcuate section, located outwardly, can be loosely inserted into the recess in the base plate. The outer longer section has a shoulder at its lower side which rests against a corresponding abutment at the end of the base plate.

The drawing die can be provided on a two-part holding claw with each part at its end having a recess corresponding and supplementing the other to hold the drawing die used for deforming the sleeve and the opposite ends of the holding claw are supported in the lower device part.

The outer surfaces of the parts forming the holding claw and extending between its ends narrow toward the inner end in the form of a wedge and bear against correspondingly shaped contact surfaces on receiving means formed in the base plate.

In the working position, the holding claw can be fixed relative to the base plate. To fix the holding claw, a threaded bolt acting in the long direction of the claw interacts with a corresponding bore in the claw.

Preferably, the holding claw has a shoulder-shaped stop for limiting its depth of insertion into the base plate.

The recesses in the two parts of the holding claw holding the drawing die can be lined with insert pieces of a wearresistant material. Advantageously, the insert pieces are replaceable.

The piston rod used with the drawing cylinder and the piston rod utilized with the counteracting cylinder are secured to the base plate of the lower device part, such as by screws.

A pressurized medium supply line is connected to the cylinder chamber of the drawing cylinder below the piston while it is connected to the counteracting cylinder above the piston. In other words, the pressurized medium is conveyed into these two cylinders in opposite directions relative to the axial direction of the cylinders.

In one embodiment, the cylinder chambers of the cylinder-piston units are provided in a uniform cylinder housing which forms the upper device part. It is also possible, however, to locate the cylinders as separate members on a base plate and to connect them to the base plate and a cover plate by means of screws. In this second arrangement, it is advantageous to position a stiffening plate in the plane of action containing the axes of the cylinders with the stiffening plate connected by welding or screws to the base plate and the cover plate.

A carrying handle can be provided on the upper device part.

The basic feature of the invention is that the cylinder-piston units which effect the relative movement between the lower device part including the drawing die and the upper device part supported by the sleeve, are not arranged symmetrically relative to the drawing die or to the axes of the reinforcing bars to be connected, rather, both of the cylinder-piston units are located eccentrically, that is, both on one side of the drawing die axis. To absorb the high bending moments which result due to the eccentricity of the application of force by the device, one of the cylinder piston units acts as a counteracting cylinder with the pressurized medium being admitted into the counteracting cylinder in the opposite direction to which the medium is supplied into the drawing cylinder. Accordingly, bending moments act in opposite directions along the axes of the cylinders so that the bending moments compensate one another and the eccentric arrangement does not provide any disadvantage. Accordingly, it is possible to place the device on one side of the reinforcing bars to be coupled together and to construct the units acting on the reinforcing bars so that they are small and as narrow as possible while affording the required application of force. Therefore, the parts of the device can be mounted on a bracket having a width which easily fits in the space between adjacent parallel reinforcing bars.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 7 is a sectional view, similar to FIG. 1, taken through the upper device part of a second embodiment of the invention;

FIG. 8 is a cross sectional view taken along the line VIII—VIII in FIG. 7;

DETAIL DESCRIPTION OF THE INVENTION

Figure 1:
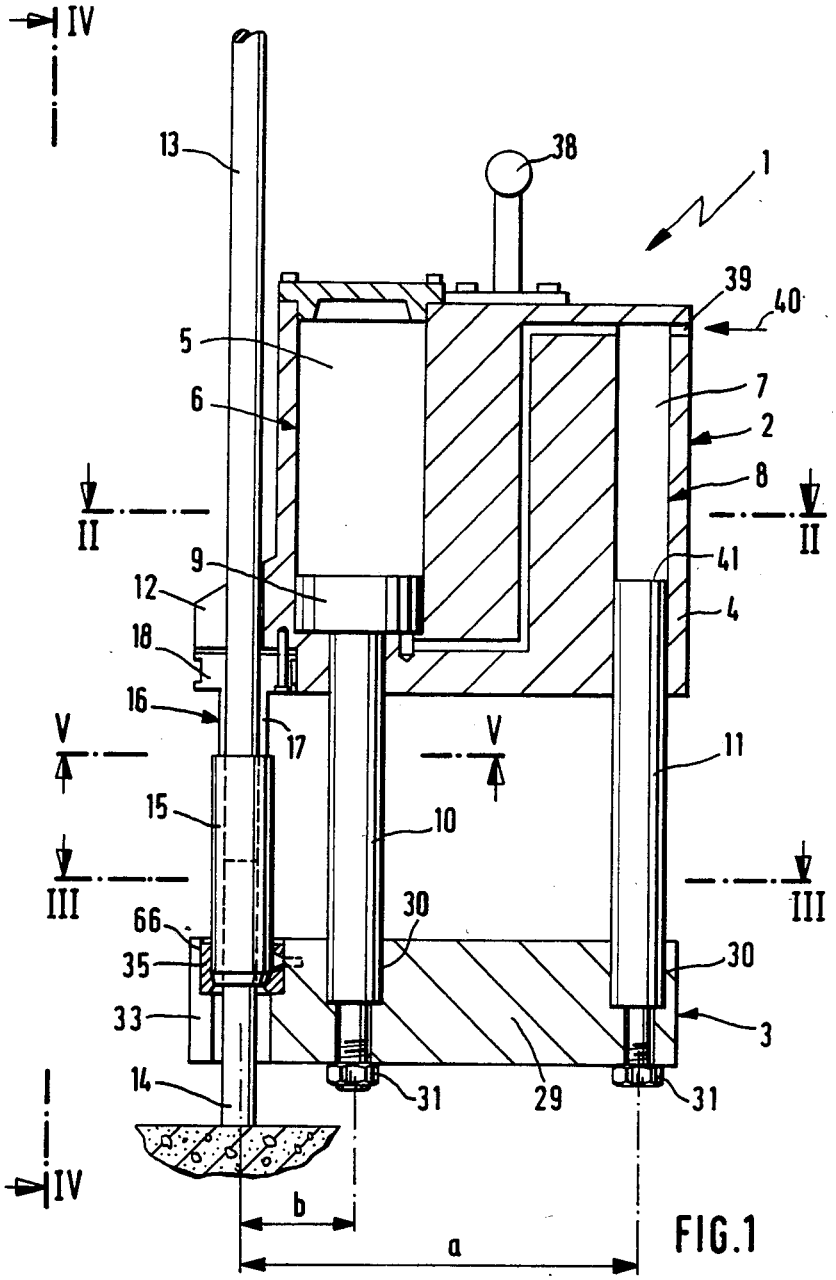
FIG. 1 is a longitudinal sectional view illustrating a first embodiment of the device incorporating the invention.

In FIGS. 1 through 4, a device 1 is illustrated consisting basically of an upper device part 2, a lower device part 3 aligned below the upper part with the two parts interconnected by cylinder-piston units so that one part can be moved relative to the other.

Upper device part 2 includes a unitary cylinder housing 4 bored to provide a cylinder chamber 5 for a drawing cylinder 6 and a cylinder chamber 7 for a counteracting cylinder 8. These two cylinders are in parallel relation and are spaced apart from one another. A piston 9 located at one end of a piston rod 10 is movably displaceable in the axial direction within cylinder chamber 5. A piston rod 11 is movably displaceably located in the cylinder chamber 7.

Figure 2:
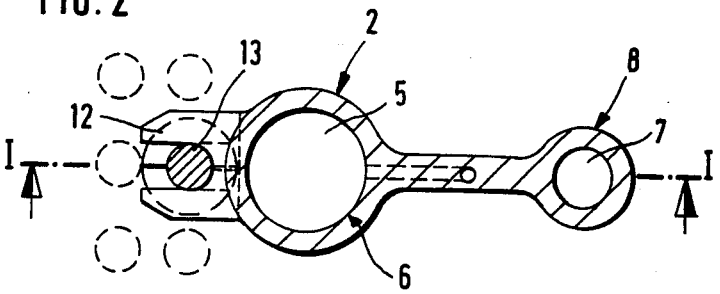
FIG. 2 is a cross sectional view taken along the line II—II in FIG. 1.

A fork-shaped support bracket 12, note FIG. 2, is formed integrally with and extends from one end of the cylinder housing 4. While the bracket 12 encloses one of the reinforcing bars 13, 14 to be connected together, the device 1 can be inserted, due to the shape of the support bracket, into the space between reinforcing bars adjacent to the ones being connected, note in FIG. 2 that the adjacent bars are shown in dashed lines and the bracket is shaped so that it can fit around the reinforcing bar 13 to be connected to bar 14. Fitted over and extending along the abutting ends of the reinforcing bars 13, 14 is a sleeve 15. The sleeve 15 is to be secured about the abutting ends of the reinforced bars by radial deformation effected by the device 1. Though not illustrated, the surfaces of the reinforcing bars 13, 14 are deformed or profiled. These deformations can be sickle-shaped ribs known in conventional ribbed reinforcing bars, however, the deformations can be in the form of hot-rolled ribs extending along a helical line in the form of a thread.

Figure 5:
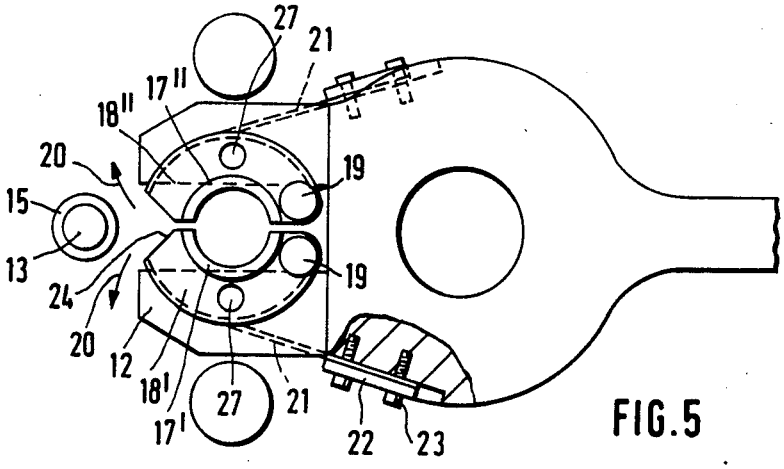
FIG. 5 is a bottom view of the upper device part taken along the line V—V in FIG. 1.
Figure 6:
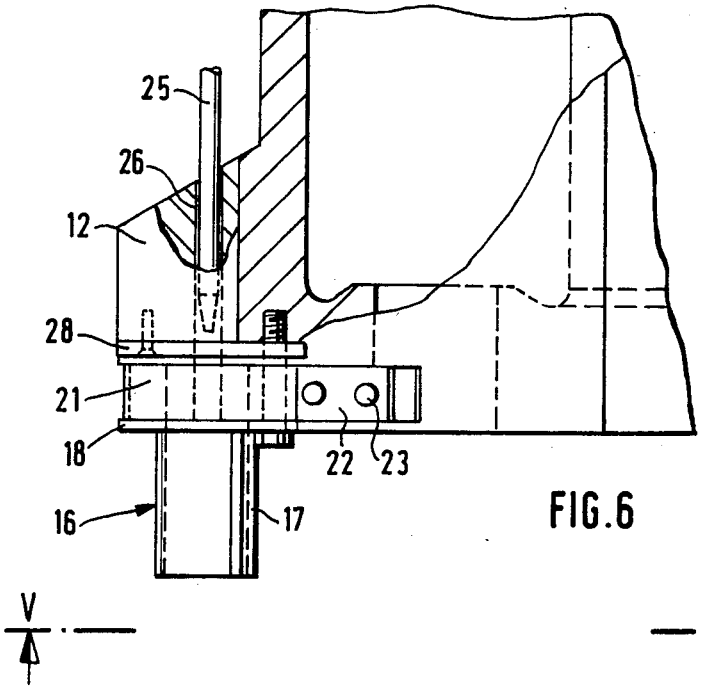
FIG. 6 is a side view, partly in section, of a portion of the lower region of the upper device part.

As seen in FIG. 1, a support sleeve 16 extends downwardly from the underside of support bracket 12 to the upper end of sleeve 15. Support sleeve 16 has a lower part 17 with a relatively small outside diameter with its bottom end resting against the upper end of the sleeve 15. The outside diameter of lower part 17, note FIG. 1, is small relative to the outside diameter of sleeve 15. At the upper end of the lower part 17 the support sleeve has a head 18 formed by a flange-like outwardly extending projection coaxial with the lower part 17. Head 18 is in form-locking and frictional engagement with the lower side of bracket 12. Support sleeve 16 is made up of two shell-shaped parts 17', 18' and 17'', 18'', note FIG. 5. The shell-shaped parts are secured to the bracket 12 by bolts 19 and the shell-shaped parts can be pivoted about the bolts in the direction of the arrows 20 opening the space between the parts. The pivotal movement of the shell-shaped parts is performed against the action of flat springs 21 fixed to the outside surfaces of the bracket 12 by means of pressure pieces 22 and screws 23. At the opposite sides from the bolts 19, the flange-like projections 18' and 18'' of the head 18 of the support sleeve 16 have end face bevels 24. By means of the bevels 24, the device can be slipped with the bracket 12 above the sleeve 15 over or around the reinforcing bar 13 so that the two shell-shaped parts 17', 18' and 17'', 18'' of the support sleeve 16 open and then close surrounding the bar 13. In the closed position, the two shell-shaped parts of the support sleeve 16 can be locked by adjusting bolts 25, note FIG. 6, which extend downwardly and are guided within bores 26 in the bracket 12 and penetrate into bores 27 in the flange-like projections 18', 18''. Plate 28, acting as a wearing part, is attached to the bottom side of bracket 12, such as by screws.

Figure 2A:
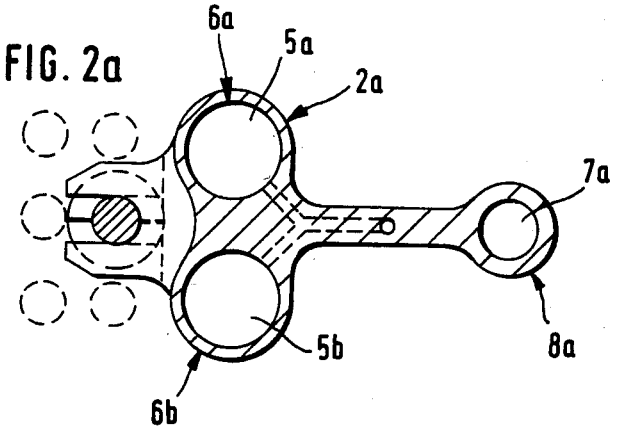
FIG. 2*a* is a cross sectional view corresponding to FIG. 2 taken through another embodiment of the invention.

In FIG. 2*a* another embodiment of the device 1 shown in FIG. 1 is illustrated, however, only in cross section. In this embodiment, instead of a single drawing cylinder 6, two drawing cylinders 6*a*, 6*b* are arranged alongside one another and symmetrical to a plane extending through the axis of the counteracting cylinder and the axis of the reinforcing bar to be connected. The plane symmetrically separating the two drawing cylinders 6*a*, 6*b* includes the axes of the counteracting cylinder 8*a* and of the reinforcing bars being coupled. Similar to the arrangement in FIG. 2, the upper device part 2*a* includes a cylinder chamber 7*a* within the counteracting cylinder 8*a*.

Figure 3:
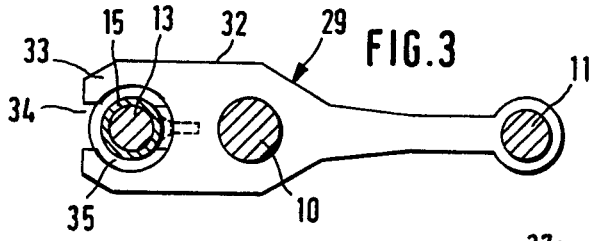
FIG. 3 is a cross sectional view taken along the line III—III in FIG. 1.

In the embodiment of FIG. 1, the lower device part 3 is made up of a base plate 29 with blind end bores 30 axially aligned below the drawing cylinder 6 and the counteracting cylinder 8. Accordingly, the piston rods 10, 11 of the drawing cylinder 6 and the counteracting cylinder 8 extend downwardly and are fastened within the blind end bore 30 by set screws 31. As can be seen in FIG. 3, the forward part 32, is wider than the rearward part, that is, the forward part is the part which extends around the reinforcing bar 14. The forward end 33 of the forward part 32 of the base plate has the shape of a fork and is divided by a longitudinal slot 34 which forms a space for the drawing die 35.

Figure 3A:
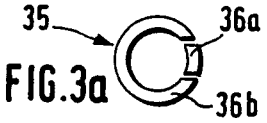
FIGS. 3*a* and 3*b* are detailed showings of different embodiments of the drawing die.
Figure 3B:
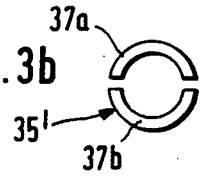
Figure 4:
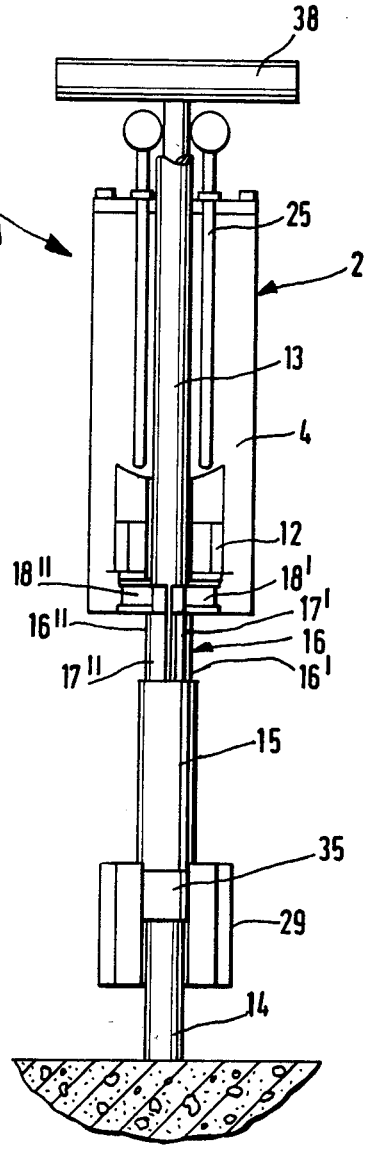
FIG. 4 is a front view taken along the line IV—IV in FIG. 1.

Drawing die 35 is an annular member and is divided into two arcuate parts 36*a*, 36*b*. The inner arcuate part 36*a* is shorter than the outer arcuate part 36*b* and both of these parts are inserted into a recess 66 in the base plate 29. The combination of these two parts forms a complete annular member and inner part 36*a* is secured to the base plate 29, by means of screws, and forms a closure for the opening left in the longer outer arcuate part 36*b*. The opening formed by the outer arcuate part 36*b* is of a size that permits the device to be fitted from the side onto the reinforcing bars to be connected. Subsequently, after the placement of the device has been effected, the outer arcuate part 36*b* is inserted into the recess 66, note FIG. 3*a*. It is possible, however, that the drawing die can be made up of two halves 37*a*, 37*b* both of which can be removed and inserted during the placement of the device, note FIG. 3*b* showing the two halves. Note in FIG. 1 that the inside diameter of the drawing die 35 from the top toward the bottom for at least a substantial part of its axial length fits over the sleeve 15, and, as a result, has a larger diameter for at least the substantial part than the lower part 17 of support sleeve 16. Accordingly, as viewed in FIG. 1, after the drawing die 35 moves upwardly over the sleeve 15 the substantial axially extending part can move telescopically over the lower part 17 of the support sleeve 16.

Figure 11:
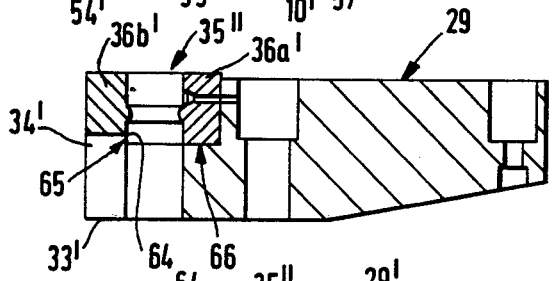
FIG. 11 is a sectional view through another embodiment of a base plate for the lower device part.
Figure 12:
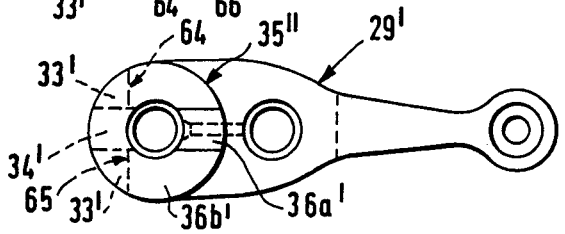
FIG. 12 is a top view of the base plate shown in FIG. 11.

In FIGS. 11 and 12 another embodiment of the base plate is shown with FIG. 11 illustrating the base plate in a longitudinal section and FIG. 12 showing a top view.

Base plate 29' has a longitudinal slot 34' extending inwardly from its forward end 33'. Longitudinal slot 34' includes a recess 66 for receiving the drawing die 35''. Drawing die 35'' is annular in shape and consists of a shorter inner arcuate part 36*a'* fastened to the base plate 29', such as by a screw, and a correspondingly longer outer arcuate part 36*b'* loosely fitted into the recess 66 and completing the annular shaped drawing die 35''.

Since the annular drawing die 35'' is subjected to unusually high radial forces during the plastic deformation of the sleeve 15, these forces must be absorbed by the fork-shaped base plate 29'. Accordingly, the longer outer arcuate part 36*b'* of the drawing die has a shoulder 64 at its bottom side. In the inserted state, shoulder 64 bears against a corresponding shoulder 65 at the forward end 33' of the base plate 29', note FIG. 11. As a result, it is ensured that the radial forces occurring in the drawing die in the region of these shoulders 64, 65 are transmitted only in the form of forces normal to the base plate 29'. With these normal forces acting perpendicularly on the shoulders, whereby the two arms of the base plate 29' are not spread apart but are loaded only in the longitudinal direction of the base plate.

To produce a pressure sleeve joint using the device 1 incorporating the present invention, the device is placed in position after the reinforcing bars 13, 14 have been set in place along with the sleeve 15 fitting over their abutting ends. For handling the device 1, a carrying handle 38 is provided, note FIGS. 1 and 4. The device 1 is positioned with the bracket 12 located above the sleeve 15 in a position so that the two shell-shaped parts 17', 18' and 17", 18" of the support sleeve 16 surround the sleeve 15 and, as a result, cannot be closed. The device is held in this position with the plate 28 shown in FIG. 6 resting on the top of the sleeve 15. Sleeve 15 can be secured in this position, for example, by winding lashing wire around the reinforcing bar 14 immediately below the sleeve. In this position there is sufficient space in the region of the lower device part 3 for the insertion of the longer arcuate part **36*b* of the drawing die 35. With the drawing die completed, the device 1 is lifted slightly upwardly so that the two shell-shaped parts of the support sleeve 16 move upwardly from the region of the sleeve 15 and enclose the bar 13. The support sleeve 16 can now be placed on top of the sleeve 15 as is shown in FIG. 1**.

A pressurized medium is introduced through the supply line 39 in the direction of the arrow 40, see FIG. 1. The pressurized medium passes into the counteracting cylinder chamber 7 into contact with the surface 41 of the piston rod 11 within the counteracting cylinder 8. Further, from chamber 7 the pressurized medium continues its flow to the lower end of the cylinder chamber 5 where it contacts the bottom of the piston 9 located on the upper end of the piston rod 10 within the drawing cylinder 6. Accordingly, the pressurized medium is fed into the two chambers in opposite directions relative to the axial directions of the chambers. Accordingly, a drawing force is applied within the drawing cylinder 6 while a pressing force acts within the counteracting cylinder 8. It should be noted that there is a considerable difference in the area of the surface 41 as compared to the area of the lower face of the piston 9.

The ratio of the pressure surface in the drawing cylinder 6 to that in the counteracting cylinder 8 must be exactly the same as the ratio of the distance b of the axis of the drawing cylinder 6 from the aligned axes of the reinforcing bars 13, 14 or from the axes of the drawing die 35 which is the same, to the distance a of the axis of the counteracting cylinder 8 from the axes of the reinforcing bars 13, 14 or the axis of the drawing die. Consequently, the bending moment developed by the counteracting cylinder 8 compensates the bending moment developed by the action of the drawing cylinder 6 so that the base plate 29 carrying the drawing die 35 is slowly and uniformly pulled up over the sleeve 15, plastically deforming it around the end regions of the abutting reinforcing bars 13,14. While cylinder housing 4 is shown as a solid member, it is possible to construct the housing from a number of separate parts. Such an embodiment is illustrated in FIGS. 7 and 8. In this embodiment, the upper device part 2' comprises a drawing cylinder 42 and a counteracting cylinder 43 spaced laterally from one another and connected to a base plate 44. Cylinders 42, 43 are also connected together at their upper ends by a cover plate 45. The connection between the plates and the cylinders is effected by screws 46. A stiffening plate serves as a mutual stiffening member for both of the cylinders 42, 43. Stiffening plate 47 is connected to the cylinder 42 by a lug 48 and to the counteracting cylinder 43 via a pair of lateral wings 49. In all other aspects, particularly with respect to the lower device part, this device is constructed in the same manner as described in connection with FIGS. 1 through 4.

Figure 9:
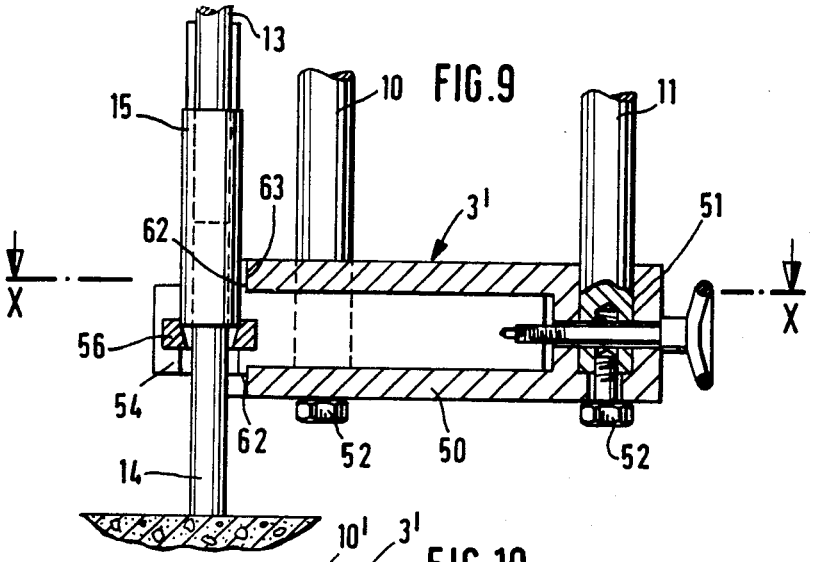
FIG. 9 is a sectional view of the lower device part of the embodiment displayed in FIG. 2*a;*
Figure 10:
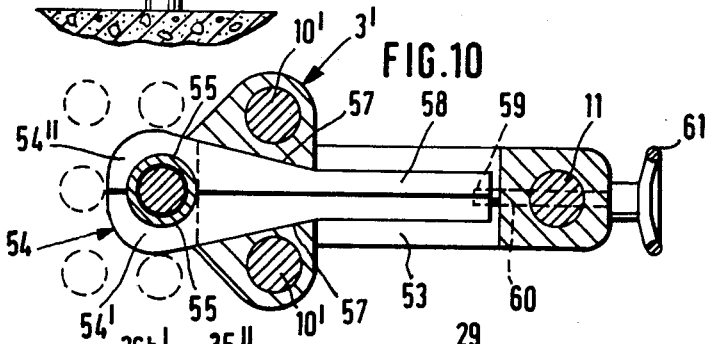
FIG. 10 is a cross sectional view taken along the line X—X of FIG. 9.

In FIGS. 9 and 10, another embodiment of the lower device part is illustrated as can be used in connection with the device shown in FIG. **2*a* which is equipped with two side-by-side drawing cylinders. In this embodiment, the lower device part 3' is composed of a base plate 50 fixed to the bottom ends of the piston rods 10, 11. The outer periphery of the base plate has the shape of the cylinder housing 2*a* shown in FIG. 2*a*. Blind-end bores 51 are formed in the base plate and these bores receive the lower ends of piston rods 10 and 11 which are secured in place by bolts 52**.

Base plate 50 has a receiving space 53 open at its end face for receiving a holding claw 54. The holding claw 54 extends from the forward end of the base plate 50 into the space 53. Holding claw 54 is made up of two narrow elongated parts 54', 54" which widen toward the forward end of the base plate. The parts 54', 54" form recesses 55 which combine to provide a circular cross-section into which the drawing die 56 is inserted. In this embodiment, the drawing die is composed of two approximately semi-circular parts which, as wearing parts, are replaceably inserted into the recesses 55 formed in the two parts 54', 54" of the holding claw 54, see FIG. 9.

As the parts 54', 54" extend into the space 53 from the forward end of the base plate, each of them has a wedge-shaped contact surface 57 terminating in a narrow end 58. A bore is formed in the rearward end face of the ends 58. A threaded bolt 60 is secured into the bore and the bolt is actuated by a knurled wheel 61. By means of the knurled wheel 61, the claw 54 can be retracted or pulled into the receiving space 53 until it contacts the forward end face 63 of the base plate 50 with its upper and lower shoulders 62. In this way, the depth of insertion of the claw 54 is limited and a constant distance b of the drawing cylinders 10 or 10' or the distance a of the counteracting cylinder 11 from the axes of the reinforcing rods 13, 14 and of the drawing die is assured.

While specific embodiments of the invention have been shown and described in detail to illustrate the application of the inventive principles, it will be understood that the invention may be embodied otherwise without departing from such principles.

We claim:

1. Device for coupling the abutting ends of a pair of axially aligned reinforcing bars as used in reinforced concrete structures, such as reinforcing bars having deformed outside surface, utilizing a coupling sleeve for joining the reinforcing bars together by pressing and plastically deforming the coupling sleeve around the abutting ends of the reinforcing bars, comprising an upper device part, a lower device part aligned below said upper device part, an annular drawing die having a central axis, and an inside diameter and an outside diameter encircling said central axis, said drawing die is supported on said lower device part and is arranged to be displaced in the direction of the central axis toward said upper device part along the full axial length of the coupling sleeve for tightly securing the coupling sleeve onto the reinforcing bars, cylinder-piston means eccentrically connected to said upper and lower device parts relative to the central axis of said drawing die for moving said lower device part relative to and toward said upper device part and displacing said drawing die over the coupling sleeve, the central axis of said drawing die being alignable with the axes of the reinforcing bars to be coupled, said cylinder-piston means comprising at least one drawing cylinder-piston unit spaced laterally from and in generally parallel relation with the central axis of said drawing die, said drawing cylinder-piston unit comprising a drawing cylinder located in said upper device part and a drawing piston having one end movably displaceably located within said drawing cylinder and the other end secured to said lower device part, and counteracting cylinder-piston unit spaced laterally from and in generally parallel relation with the central axis of said drawing die and the axis of said drawing cylinder-piston unit, said counteracting cylinder-piston unit is located on the same side of the drawing die as said drawing cylinder-piston unit, said counteracting cylinder-piston unit comprising a counteracting cylinder-piston unit comprising a counteracting cylinder located within said upper device part and a counteracting piston having one end movably displaceably located within said counteracting cylinder and the other end secured to said lower device part, and means for supplying a pressurizing medium to said drawing cylinder and counteracting cylinders with said means supplying the pressurizing medium into said cylinders in opposite directions relative to the axial direction of said cylinders, means arranged to bear against the end of the coupling sleeve closer to said upper device part for securing the coupling sleeve against the axial displacement toward said upper device part as said drawing die is displaced axially over the sleeve toward said upper device part, said upper and lower device parts transverse of the axial direction of said drawing cylinder and counteracting cylinder each has a forward end closer to the axis of said drawing die and a rearward end more remote from the axis of said drawing die, a fork-shaped bracket secured to the forward end of said upper device part and said bracket arranged to provide support relative to the coupling sleeve as said drawing die moves over the coupling sleeve toward said bracket, said forward end of said lower device part and the forward end of said upper device part formed by said fork-shaped bracket each having an opening extending through the forward end thereof with the opening being at least large enough to receive the reinforcing bars to be coupled whereby said device for coupling can be placed laterally onto the reinforcing bars prior to coupling the reinforcing bars together, said forward end of said lower device part inwardly of and in communication with the opening therein has an annularly shaped recess therein for receiving said drawing die, said drawing die comprising at least separate first and second die parts extending circumferentially relative to the central axis, of said drawing die and combining to form said annular drawing die, said first and second die parts being insertable into said recess in the direction extending downwardly from said upper device part toward said lower device part so that said first and second die parts completely laterally enclose one of the reinforcing bars to be coupled, said means for securing the coupling sleeve comprises a support sleeve connected to the lower end of said bracket and extending therefrom toward said drawing die and arranged to bear on the end of the coupling sleeve closer to said bracket, said support sleeve comprising two axially coextensive parts arranged to be placed around the reinforcing bars to be coupled together, said two coextensive parts being movably mounted at said fork-shaped bracket on the forward end of said upper device part so that said device for coupling can be laterally placed around the reinforcing bars, and said drawing die having a first end closer to said upper device part and a second end spaced in the axial direction of said drawing die further from said upper device part, said drawing die from said first end thereof for a substantial part of the axial direction toward said second end has an inside diameter greater than the outside diameter of said support sleeve, said two coextensive parts having a length such that the two coextensive parts can enter said substantial part of the drawing die axial direction so that said drawing die can move telescopically over said two coextensive parts of the support sleeve in deforming the coupling sleeve.

2. Device, as set forth in claim 1, wherein said parts of said support sleeve are shell-shaped parts, and each said shell-shaped part having a radially outwardly extending flange-like projection at the upper end of said part with said flange-like projection arranged to bear against the lower side of said bracket.

3. Device, as set forth in claim 2, including means for connecting each of said shell-shaped parts to said bracket so that said parts can be pivoted about axes which are parallel to and spaced laterally from the axis of said drawing die.

4. Device, as set forth in claim 3, including spring means secured to said bracket for engagement with said shell-shaped parts for biasing said parts into the closed position of said support sleeve.

5. Device, as set forth in claim 1, wherein said lower device part includes a base plate including said recess and said drawing cylinder-piston unit and said counteracting cylinder-piston unit interconnect said base plate to said upper device part.

6. Device, as set forth in claim 5, wherein said first and second die parts each have a different arc length with said die part having the shorter arc length being fixable to and releasable from said base plate, and said die part of the longer arc length being loosely insertable into said recess in said base plate.

7. Device, as set forth in claim 6, wherein said longer arc length die part is located closer to the forward end of said base plate and has a shoulder extending transversely of the direction between the forward and rearward end of said base plate, said base plate has abutments adjacent the forward end thereof extending in parallel and contacting relation with said shoulder on said outer die part closer to the forward end of said base plate.

8. Device, as set forth in claim 1, wherein said means for supplying a pressurizing medium comprises a supply line located within said upper device part and said supply line connected to the lower end of said drawing cylinder-piston unit and to the upper end of said counteracting cylinder-piston unit so that the pressurized medium acts upwardly within said drawing cylinder-piston unit and downwardly within said counteracting cylinder-piston unit.

9. Device, as set forth in claim 1, wherein said upper device part includes a carrier handle formed on the upper part thereof.

10. Device, as set forth in claim 1, wherein two said drawing cylinder-piston units are arranged equidistantly spaced from the axis of said drawing die and arranged symmetrically on the opposite sides of a plane including the central axis of said drawing die and the axis of said counteracting cylinder in said counteracting cylinder-piston unit.

11. Device, as set forth in claim 10, wherein the area of the piston surfaces of said drawing cylinder-piston unit and said counteracting cylinder-piston unit are in reverse ratio to the distances of the axes of said cylinder-piston units from the axis of said drawing die.

* * * * *